US005692782A

United States Patent [19]

Fischer

[11] Patent Number: 5,692,782

[45] Date of Patent: Dec. 2, 1997

[54] TELESCOPABLE VACUUM CLEANER SUCTION PIPE

[75] Inventor: Hans Fischer, Seebach, Germany

[73] Assignee: Fischer-Rohtechnik GmbH, Achern-Fautenbach, Germany

[21] Appl. No.: 693,883

[22] Filed: Aug. 5, 1996

[30] Foreign Application Priority Data

Aug. 5, 1995 [DE] Germany ..... 195 28 814.9

[51] Int. Cl.[6] ..... F16L 35/00

[52] U.S. Cl. ..... 285/7; 285/24; 285/303; 285/315; 285/317; 285/423

[58] Field of Search ..... 285/7, 24, 27, 285/315, 316, 317, 303, 423

[56] References Cited

U.S. PATENT DOCUMENTS

| | | | |
|---|---|---|---|
| 2,823,934 | 2/1958 | Gorrell et al. | 285/316 X |
| 2,913,263 | 11/1959 | Zajac | 285/317 X |
| 3,049,367 | 8/1962 | Lashta | 285/7 |
| 4,951,977 | 8/1990 | Shutt | 285/316 |
| 5,332,266 | 7/1994 | Canale | 285/7 |

FOREIGN PATENT DOCUMENTS

| | | |
|---|---|---|
| 520534A1 | 12/1992 | European Pat. Off. . |
| 3718578C2 | 4/1992 | Germany . |
| 4104049A1 | 7/1992 | Germany . |
| 4200527C2 | 11/1995 | Germany . |

*Primary Examiner*—Dave W. Arola
*Attorney, Agent, or Firm*—Michael J. Striker

[57] ABSTRACT

A telescopable vacuum cleaner suction pipe has an outer pipe, an inner pipe having arresting depressions, and arresting element coupled with the outer pipe and engaging in the arresting depressions, a manually actuatable slider unblocking the arresting element, a pressure-loaded blocking spring which when the slider is not actuated holds the arresting element in a locking position and when the slider is actuated the arresting element is movable against the blocking spring to unlocking position for a relative displacement of the inner pipe and the outer pipe, the arresting element being formed as two clamping bodies engaging in separate arresting depressions and inclined at acute angles relative to a longitudinal axis of the out pipe, a guiding body form-lockingly received in the outer pipe and having inclined sliding planes on which the clamping body are displaced, one of the blocking bodies which blocks a relative movement of the inner pipe and the outer pipe is displaceable for releasing its blocking position by the slider from the arresting depression along the inclined sliding plane.

36 Claims, 9 Drawing Sheets

TELESCOPABLE VACUUM CLEANER SUCTION PIPE

BACKGROUND OF THE INVENTION

The present invention relates to a telescopable vacuum cleaner suction pipe vacuum cleaner suction pipe.

More particularly, it relates to a telescopable vacuum cleaner suction pipe with an outer pipe and an inner pipe having arresting depressions, in which an arresting element which couples the outer pipe and which is blockable by a manually actuateable slider engages, wherein the arresting element is held by a pressure-loaded blocking spring when the slider is not actuated in a locking position, and when the slider is actuated is movable against the force of the blocking spring for a relative displacement of the inner pipe and the outer pipe in their unlocking position.

Such a telescopable vacuum cleaner suction pipe is disclosed in the European Patent Document EP 0 520 534 A1. The arresting element disclosed in this document is composed of arresting plates with spherical ends in a cross-section. One end is guided in a sleeve which surrounds the inner pipe and has a hinge recess so as to be turnable, while the other end engages in a corresponding arresting recess of the inner pipe. For holding the plate-shaped arresting element in its blocking position, a slider is slidingly displaceable in the outer pipe provided with a concentric expansion and is acted by a pre-stressed, pressure-loaded blocking spring. The slider is always displaced by the blocking spring into the locking position in which it holds down the arresting element. By actuation of the slider against the force of the blocking spring the arresting element is released. Therefore it can be pulled out or pressed out from the arresting depression of the inner pipe with its spherical end after the relative displacement of the outer pipe to the inner pipe, and a small turning movement about its other end formed as a turning pivot is performed. The above described telescopable vacuum cleaner suction pipe has the disadvantage that the unlocking with the slider is performed only during pulling of the outer pipe and inner pipe relative to one another in a handling direction, but not during pushing toward one another. During pushing toward one another of the outer pipe to the inner pipe, the slider must be actuated opposite to the pressing direction against the action of the blocking spring.

Another disadvantage of these known telescopable vacuum cleaner suction pipe is that in the case of impact-like pressure loading on the inner pipe or the outer pipe, the arresting element of the slider can be withdrawn against the force of the blocking spring so far that it can be momentarily displaced in the next arresting depression in the pressing direction.

Finally, this vacuum cleaner suction pipe has a further disadvantage connected with the collar-like expanded outer pipe. It not only makes the manufacture more expensive but also requires a space-consuming sleeve between the inner pipe and the outer pipe for operating the slider.

Another telescopable vacuum cleaner suction pipe of this type is disclosed in the German Patent Document DE 41 01 049 A1. The arresting element in this document is formed as a ball or a roller body which can be brought to its locking position by a slider arranged under the action of one or two blocking springs. When the slider is displaced against the action of the pressure and/or pull loaded blocking springs, one of the projections in the slider reaches over the arresting body and the inner pipe can displace relative to the outer pipe. In this embodiment, in addition to the collar-like expanded outer pipe, there is another disadvantage residing in the fact that during the impact-like pressure loading of the inner and/or outer pipe under the gravity force and under the roller rubbing friction of the arresting element, the slider can move the arresting body to another arresting depression against the action of the blocking spring.

The same disadvantages are characteristic for the vacuum cleaner suction pipes disclosed in the German Patent Documents DE 37 18 578 C2 and DE 42 00 527 A1.

All above mentioned telescopable vacuum cleaner suction pipes also have the disadvantage that the arresting element, whether it is a turning plate, arresting ball, arresting pin or arresting cylinder, can reach its blocking position only by a corresponding holding down element in the slider, which is under the action of the blocking spring. This blocking position is guaranteed only for such a time until the corresponding blocking spring is fatigued or weakened. Even with the orderly arranged blocking spring, the slider in the event of impact-like loading of the inner and/or the outer pipe, can be displaced to an unblocked position under the action of the released gravity force pulses in connection with the rolling or sliding friction forces applied to the arresting body. Therefore the action of such an arresting element can be characterized only as a "passive", since it always depends from the holding down position of the slider. A strongly pressure-loaded blocking spring as well as a too hard spring with a corresponding steel characteristic is however ergonomically, not favorable. With such a spring the slider during unlocking of the arresting element must be actuated opposite to the action of the hard blocking spring, which is performed under the circumstances opposite to the pressure or pulling direction of the telescopable vacuum cleaner suction pipe.

SUMMARY OF THE INVENTION

Accordingly, it is an object of present invention to provide a telescopable vacuum cleaner suction pipe of the above mentioned type, which avoids the disadvantages of the prior art.

More particularly, it is an object of present invention to provide a vacuum cleaner suction pipe which on the one hand guarantees with low pre-tensioning of the blocking spring with relatively weak characteristic an easy handling of the slider in ergonomically favorable manner in the corresponding handling direction, and on the other hand with elimination of the collar-like expansion in the outer pipe provides always a compact locking during impact-like loading of the outer and inner pipes.

In keeping with these objects and with others which will become apparent hereinafter, one feature of the present invention resides, briefly stated in a telescopable vacuum cleaner suction pipe in which the arresting element is composed of two clamping bodies which, under an opposite acute angle relative to the longitudinal access of the outer pipe, are displaceable each on an inclined sliding plane of a guiding body which is form-lockingly inserted in a recess of the outer pipe and which engage in separate arresting depressions so that the clamping body which blocks the corresponding relative movement of the inner and outer pipes for releasing of its blocking position is displaceable via the slider from its arresting depression along its inclined sliding plane.

In contrast to the prior art, the blocking spring no longer performs the active blocking of the passive arresting element, but instead to assure that the corresponding arresting element assumes the position between the outer pipe and the inner pipe, so that during a relative pressure or pull application by the friction between the guiding body mounted in the outer pipe and the arresting depression located in the inner pipe to be pulled into the gap between both pipes. Thereby the arresting element is no longer under the action of a holding-down element, but instead actively and therefore directly without the action of the blocking spring participates in the blocking action in form of a clamping wedge. This type of blocking can be identified as automatic self-clamping of the arresting element.

The blocking spring is however needed to guarantee its position between the guiding body in the outer pipe and the corresponding surface of the arresting depression in the inner pipe. This position requires only a weak spring with a flat characteristic, corresponding to the low sliding forces and the weight of the clamping body.

In accordance with an advantageous embodiment of the invention, the clamping body can be formed so that it can be pulled in a progressive raising clamping position independently from the pressure action of the blocking spring by a relative pressure or pull application of the outer pipe to the inner pipe and visa versa. For releasing the blocking position of the outer pipe with the inner pipe, the blocking clamping body is liftable by the slider from its arresting position along its inclined sliding plane against the force of the blocking spring on the outer peripheral line of the inner pipe. During the following relative movement of the outer pipe to the inner pipe the other clamping body is displaceable over the raising outer surface of its arresting depression also against the force of the blocking spring on the outer peripheral line of the inner pipe. Since the blocking spring serves only for holding-down of the blocking body, therefore, as its name indicates, it performs during the relative pressure or pull application its blocking functions in form of a blocking wedge in the intermediate space between the inner pipe and the outer pipe. The blocking spring can be formed weak and provided with a flat characteristic. With such a weak spring the slider can have a low force and thereby can act ergonomically favorable.

If one plots in a diagram over the spring path or its loading force is plotted, a spring characteristic with different steepness is obtained. The steeper the characteristic line, the harder the spring, and with the falling characteristic line a soft spring is provided. The pressure-loaded blocking spring can be formed as a cylindrical helical spring, a correspondingly shaped flat spring, a double-side conical spring, or a rubber spring.

In accordance with a further embodiment of the present invention, the clamping bodies have the shape of plates or wedges and are provided at their ends facing the arresting depressions with a flat, one-side rounded or a trapezoidal or a wedge-shaped cross-section. At their ends facing away from the arresting depressions, the clamping bodies are provided with lateral projections which form a form-locking sliding coupling with corresponding rear projections in the slider. In a kinematic reversal its of course possible to arrange the projections in the slider so that they cooperate with the corresponding rear projections at the end of the clamping body.

With the coupling engagement of the projections of the clamping body lifted from its clamping position by the slider, it is advantageous to provide the projections of the other clamping body in the slider in the displacement direction of the first clamping body, with a free running.

The sliding planes which are inclined relative to the longitudinal access of the outer pipe under acute angles $\alpha$, $\beta$ can have a different angle. In this case for obtaining the corresponding wedge action, different wall inclination of the arresting depressions is provided in correspondence with the angle of inclination. It is advantageous when both acute angles $\alpha$, $\beta$ are identical and amount in a preferable embodiment of the invention to approximately 45°.

In accordance with a further embodiment of the invention, both inclined sliding planes arranged under a corresponding acute angle $\alpha$, $\beta$ in the guiding body are provided for the use of the blocking spring acting simultaneously at both clamping bodies with a recess. The recess preferably at least partially form-lockingly engages around the blocking spring. The guiding body is provided at its both longitudinal sides with arresting grooves for a space-economical mounting on the outer pipe, the longitudinal edges of the recess in the outer pipe are formed-lockingly engaged in the arresting grooves, while the guiding body with its small sides abuts completely or partially against the associated small edges of the recess of the outer pipe. It is however also possible to provide in the guiding body for its use in the recess of the outer pipe, with rear projections which face the edges of the recess, and surround the edge regions completely or partially with the arresting projections form-locking and/or force transmitting arresting. In this case the guiding body can be clipped from the outside of outer pipe into the same.

The recess in the part of the guiding body which surrounds the outer pipe is provided with a concave abutment surface on the inner pipe and has a small thickness which is substantially equal to the difference of the inner radius of the outer pipe and the outer radius of the inner pipe with a small play of a sliding fit. In this case the outer dimensions of the inner pipe and the outer pipe differ from one another relatively little and no collar-like expansion of the outer pipe is needed.

After the insertion of the guiding body in the recess of the outer pipe as well as after the insertion of the clamping body and the blocking spring, the slider which covers the recess from all sides can be clipped on the guiding body form-lockingly and/or force-transmittingly as well as relatively displaceably, or mountable on it by a guiding screw or a pin and displaceable.

The clamping body, the guiding body, and the slider are composed of a synthetic plastic material. In contrast, the blocking spring is composed of spring steel, or when it is formed as a rubber spring, it is composed of and entropie-elastic material.

The above described vacuum cleaner suction pipe, because of the shape of the arresting depression in connection with the clamping bodies and the inventive design with the guiding body, provides a reliable rotation safety. This is however guaranteed only when both clamping bodies are located in their arresting depressions. In order to guarantee a rotary non-rotation also in their lifted position, the inner pipe is provided in a known manner with an axial groove extending parallel to its longitudinal axis, in which an arresting strip of a synthetic plastic cylinder engages, which is arranged between the outer pipe and the inner pipe and firmly coupled with the outer pipe by an arresting cam.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
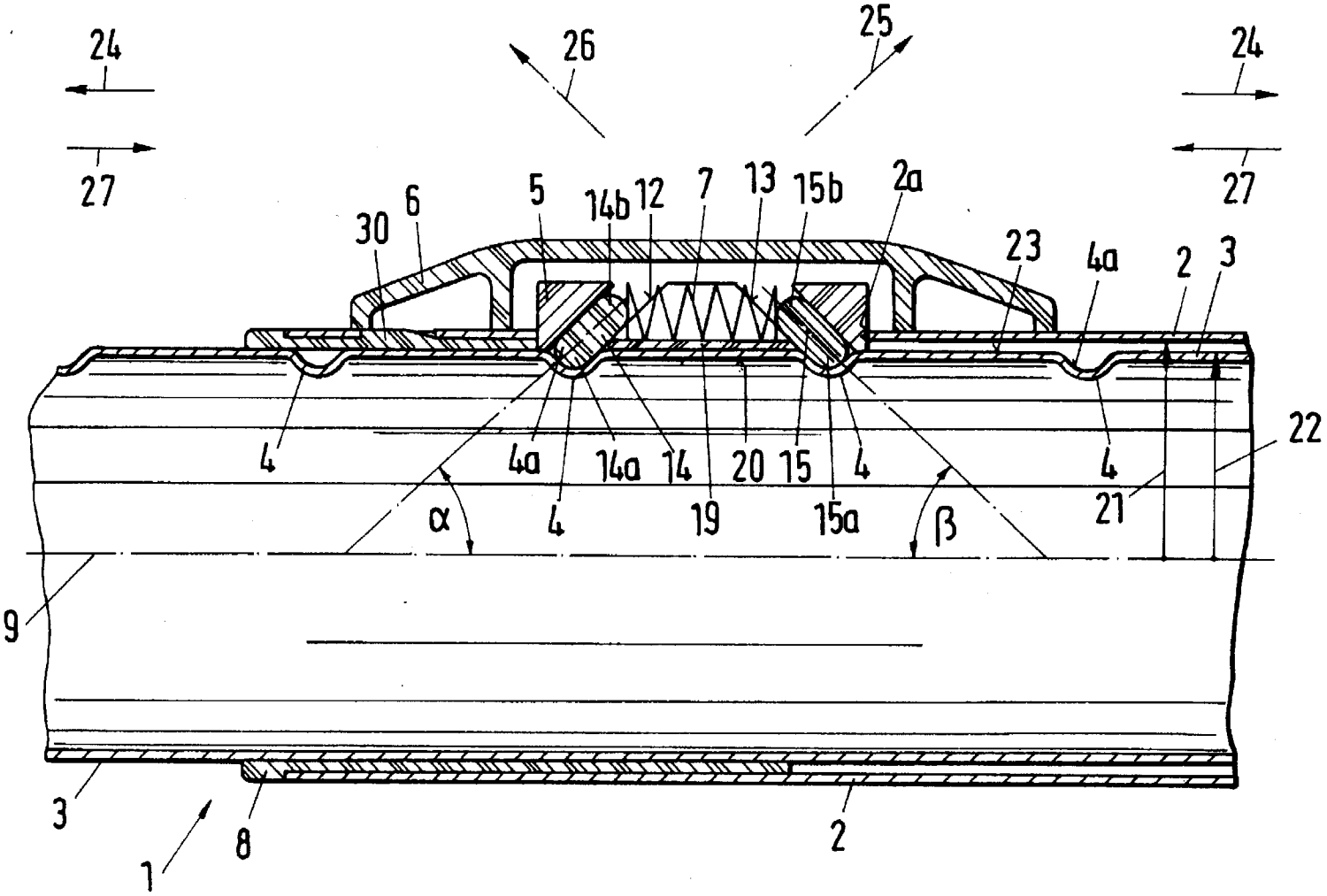
FIG. 1 is a view showing a diametrical longitudinal section through an outer pipe and an inner pipe, and a guiding body with clamping bodies in a locking position, of the inventive vacuum cleaner suction pipe.
Figure 2:
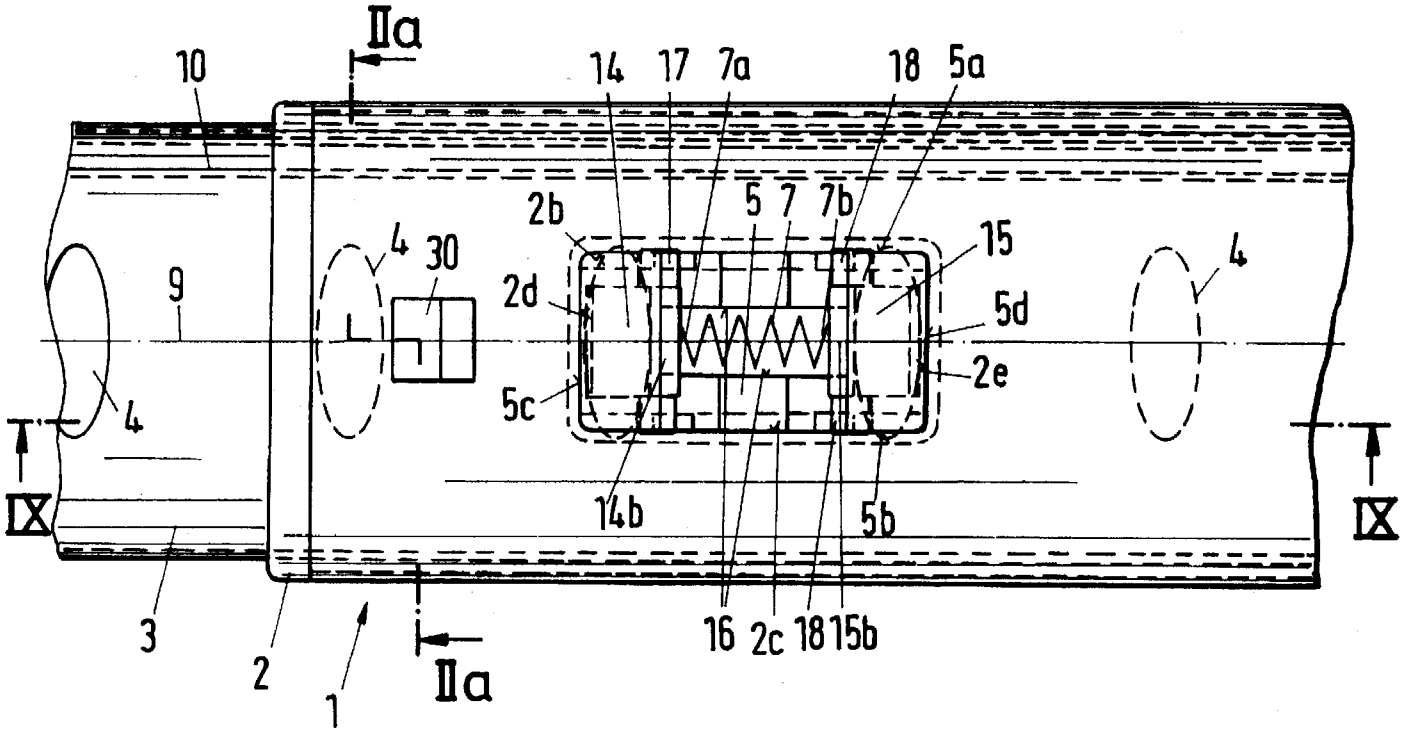
FIG. 2 is a plan view of FIG. 1 with the removed slider of the inventive vacuum cleaner suction pipe.
Figure 2A:
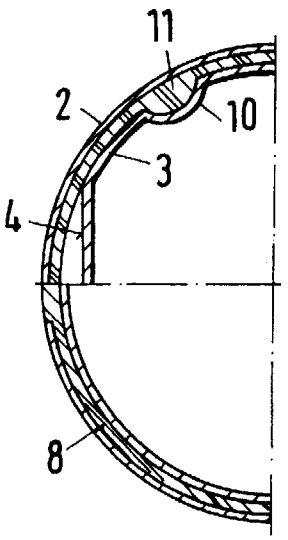
FIG. 2*a* is a view showing a partially diametrical view in a cross-section taken along the line IIa—IIa.

A telescopable vacuum cleaner suction pipe is identified as a whole with reference numeral 1. It includes, as shown in FIGS. 1, 2 and 2*a*, an outer pipe 2 and inner pipe 3 with arresting depressions 4, a guiding body 5, a slider 6, a blocking spring 7, a synthetic plastic circular cylinder 8 arranged between the outer pipe 2 and the inner pipe 3 and coupled by an arresting cam 30 with the outer pipe 2 non-rotatably. For preventing, the inner pipe 3 as shown in FIG. 2*a* is provided with an axial groove 10 extending parallel to its longitudinal axis 9 and an arresting strip 11 of the synthetic plastic circular cylinder 4 engages form-lockingly in the axial groove.

In all drawings, the longitudinal axis 9 of the inner pipe 3 is identical with the longitudinal axis of the outer pipe 2, since both pipes 2, 3 are assembled concentrically with one another. In accordance with the present invention, the arresting elements include clamping bodies 14 and 15 which under an opposite acute angle α and β relative to the longitudinal axis 9 of the outer pipe 2 are displaced on inclined sliding surfaces 12 and 13 of the guiding body inserted in a recess 2*a* of the outer pipe 2. The clamping bodies 14 and 15 engage in separate arresting openings 4.

As can be seen from the drawing, the inclined planes 12 and 13 of the guiding body 5 are provided with a recess 16. A blocking spring 7 is guided in the recess 16 parallel to the longitudinal axis 9. The blocking spring 7 is supported with its one end 7*a* against the clamping body 14 and with its another end 7*b* against the clamping body 15.

The clamping bodies 14 and 15 in the shown example are formed as plates and rounded semi-circularly at their both ends. However they can have the shape of a wedge with a flat end at the ends 14*a*, 15*a* facing the arresting depressions 14 and for example have an oval, rounded, trapezoidal, or wedge-shaped cross-section.

As can be seen from FIG. 2, the clamping bodies 14 and 15 at their ends 14*b*, 15*b* facing away from the arresting depressions 4 have lateral projections 17, 18. The projections 17, 18 together with rear projections in the slider 6 form a form-locking sliding coupling. A kinematic reversal is however also possible. In other words, the lateral rear projections can be arranged in the ends 14*b*, 15*b* of the clamping body 14, 15 to cooperate with corresponding projections of the slider 6 and to form a form-locking sliding coupling.

During the coupling engagement of the projections 17, 18 of the corresponding clamping body 14, 15 lifted from its clamping position with the slider 6, the projections 17, 18 of the corresponding other clamping body 14, 15 are provided in the slider 6 with a free running with the displacement direction of the first clamping body 14, 15.

As can be seen from FIG. 1, the acute angles α, β of the inclined sliding planes 14, 15 form angle 45° with the longitudinal axis 9 of the outer pipe 2 and the inner piper 3 an correspondingly.

The pressure-loaded spring 7 in the shown embodiment is formed as a cylindrical helical spring. However, it can be formed as a different spring, for example, a correspondingly shaped flat spring or a double-sided bevel spring, as well as a rubber spring.

The guiding body 5 is provided at its both longitudinal sides 5*a* and 5*b* with arresting grooves, and longitudinal edges 2*b*, 2*c* of the recess 2*a* of the outer pipe 2 form-lockingly engage in them. The guiding body 5 with its both small sides 5*c*, 5*d* abuts completely or partially against the associated small edges 2*d*, 2*e* of the recess 2*a* of the outer pipe 2. It is however possible to design the guiding body 5 as a guiding body which is clipped in the recess 2*a* in the outer pipe 2 so that in its peripheral edge sides 5*a*–5*d* it is provided partially or completely with rear projections for form-locking and/or force-transmitting engagement.

Furthermore, the guiding body 5 on its part 19 engaging in the recess 2*a* in the outer pipe 2 is provided with a concave abutment surface 20 at the outer surface of the inner pipe 3. It has a thickness which substantially corresponds to the difference between the inner radius 21 of the outer pipe 2 and the outer radius 22 of the inner pipe 3 with a small play for sliding fit. The thickness of the synthetic plastic circular cylinder 8 is formed similarly.

In accordance with FIGS. 1 and 2, after insertion of the guiding body 5 in the opening 2*a* of the outer pipe 2 as well as after insertion of the clamping bodies 14, 15, and the blocking spring 7, the slider 6 which overlaps the recess 2*a* at all sides is displaceably arranged on it form-lockingly and/or force-transmittingly as well as displaceably relative to the guiding body 5 so as to be clipped on it or attached by a guiding screw or a pin. In any case, the guiding body 5 is non-rotatably and relatively non-displaceably arranged in the recess 2*a* of the outer pipe 2, while in contrast the slider 6 must be arranged displaceably for the displacement of the clamping bodies 14, 15. For providing a friction-free and a maintenance-free displaceability of the clamping bodies 14, 15, the guiding body 5 and the slider 6 are composed of a synthetic plastic material.

In accordance with the present invention, the clamping bodies 14, 15 are formed so that each of them during a relative pressure or pull application of the outer pipe 2 to the inner pipe 3 and visa versa is pulled as a wedge in a progressively increasing clamping position independently from the pressure action of the clamping spring 7. This principle of blocking can be identified as automatic self-clamping.

For releasing the blocking position of the outer pipe 2 with the inner pipe 3, the corresponding blocking clamping body 14 or 15 is liftable by the slider 6 from an arresting depression 4 along its inclined sliding plane 12, 13 against the force of the locking spring 7 on the outer peripheral line 23 of the inner pipe 3. During the following relative movement of the outer pipe 2 to the inner pipe 3, the other clamping body 14 or 15 is displaceable over the raising surface 4*a* of its arresting depression 4 simultaneously against the force of the blocking spring 7 on the outer peripheral line 23 of the inner pipe 3.

The operation of the new vacuum cleaner suction pipe 1 and its blocking device is described herein below with reference to FIGS. 3–9, in which the pads corresponding to the pads shown in FIGS. 1, 2 and 2*a* are identified with the same reference numerals.

Figure 3:
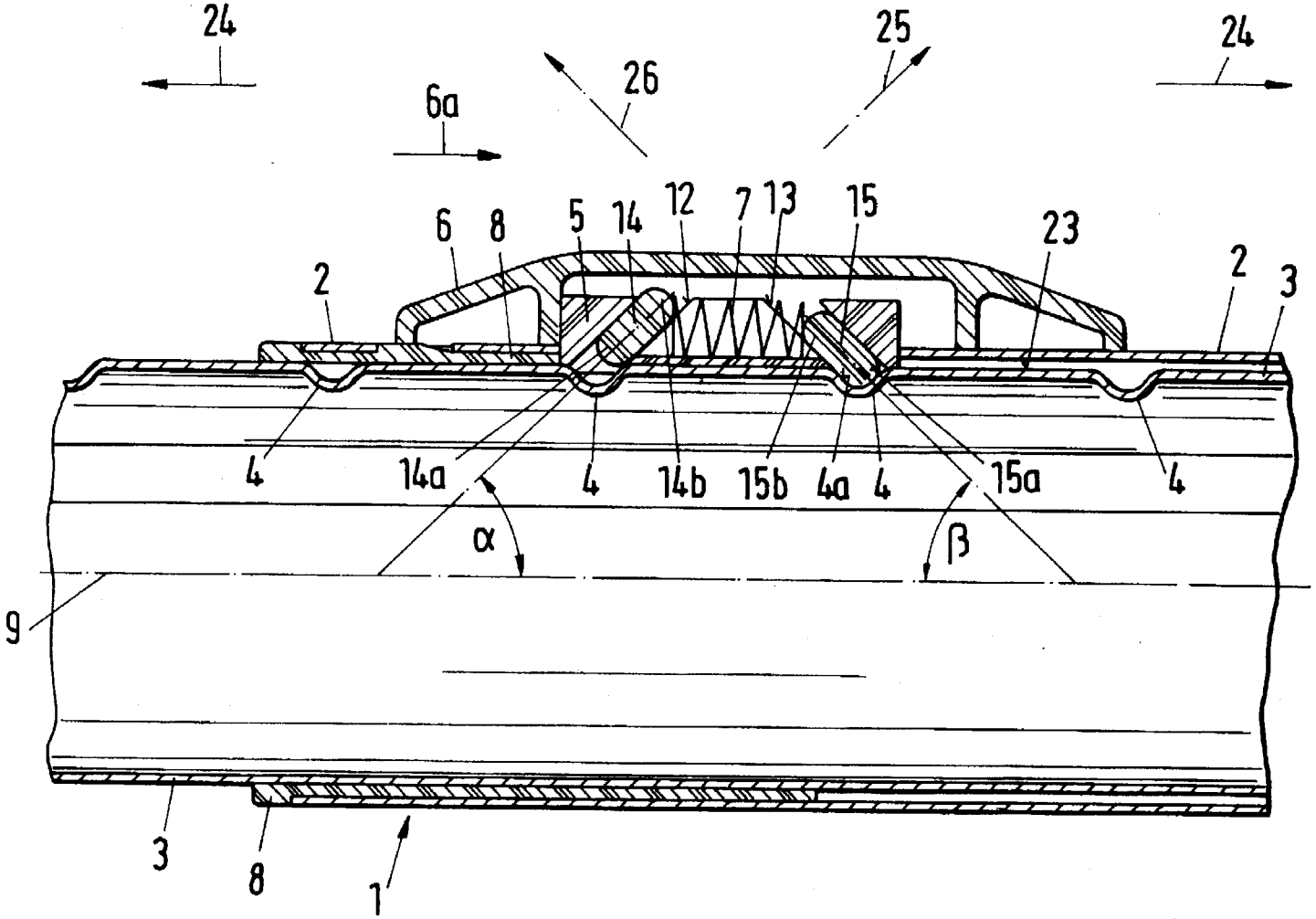
FIG. 3 is a view substantially corresponding to the view of FIG. 1, but as seen in direction of an arrow 6*a* for pulling out a slider which displaces the inner pipe and the outer pipe, and a left clamping body which blocks the out position in a lifted position.

Starting from the position of FIG. 1, the slider 6 is displaced to the right in accordance with FIG. 3 in direction of the arrow 6*a* for pulling the outer pipe and the inner pipe 3 relative to one another in direction of the arrow 24. In this case the clamping body 14 on its projections 17 engages at the end 14*b* the not shown rear projections of the slider 6 and the inclined sliding plane 12 is displaced upwardly against the force of the spring 7 in direction of the arrow 25 so far until its lower, rounded end 14*a* reaches the outer peripheral line 23 of the inner pipe 3. At this moment the inner pipe 3 is unlocked from the outer pipe 2 and can be pulled away in direction of the arrow 24. During this relative displacement of the outer pipe 2 relative to the inner pipe 3 by the slider 6 in accordance with FIGS. 3 and 4, the clamping body 14 sits with its end 14*a* on the outer peripheral line 23 of the inner pipe 3. Simultaneously, the other clamping body 15 is displaced on the raising upper surface 4*a* of the arresting depression 4 against the force of the spring 7 in direction of the arrow 26, until it also sits in accordance with FIG. 4 on the outer peripheral line 23 of the inner pipe 3. During further relative movement of the outer pipe 2 to the inner pipe 3, the both clamping bodies 14 and 15 engage under the action of the blocking spring 7 again in the next passing arresting depressions 4, so that again a locking position corresponding to the position 1 is obtained.

Figure 4:
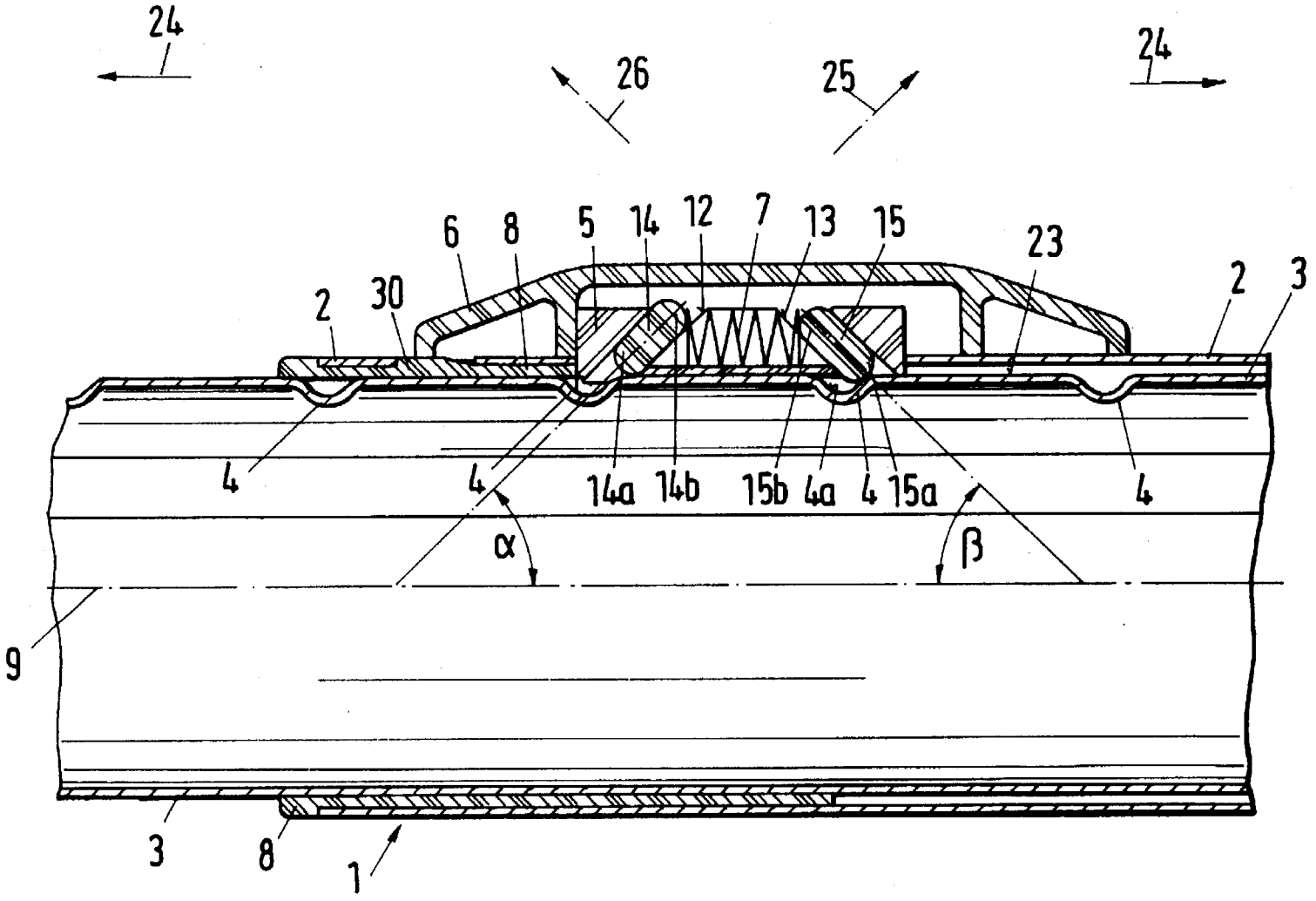
FIG. 4 is a view corresponding to the view of FIG. 3, but showing a relative movement of the outer pipe to the inner pipe and therefore against the force of a blocking spring on the outer peripheral line of the second clamping body displacing the inner pipe.
Figure 7:
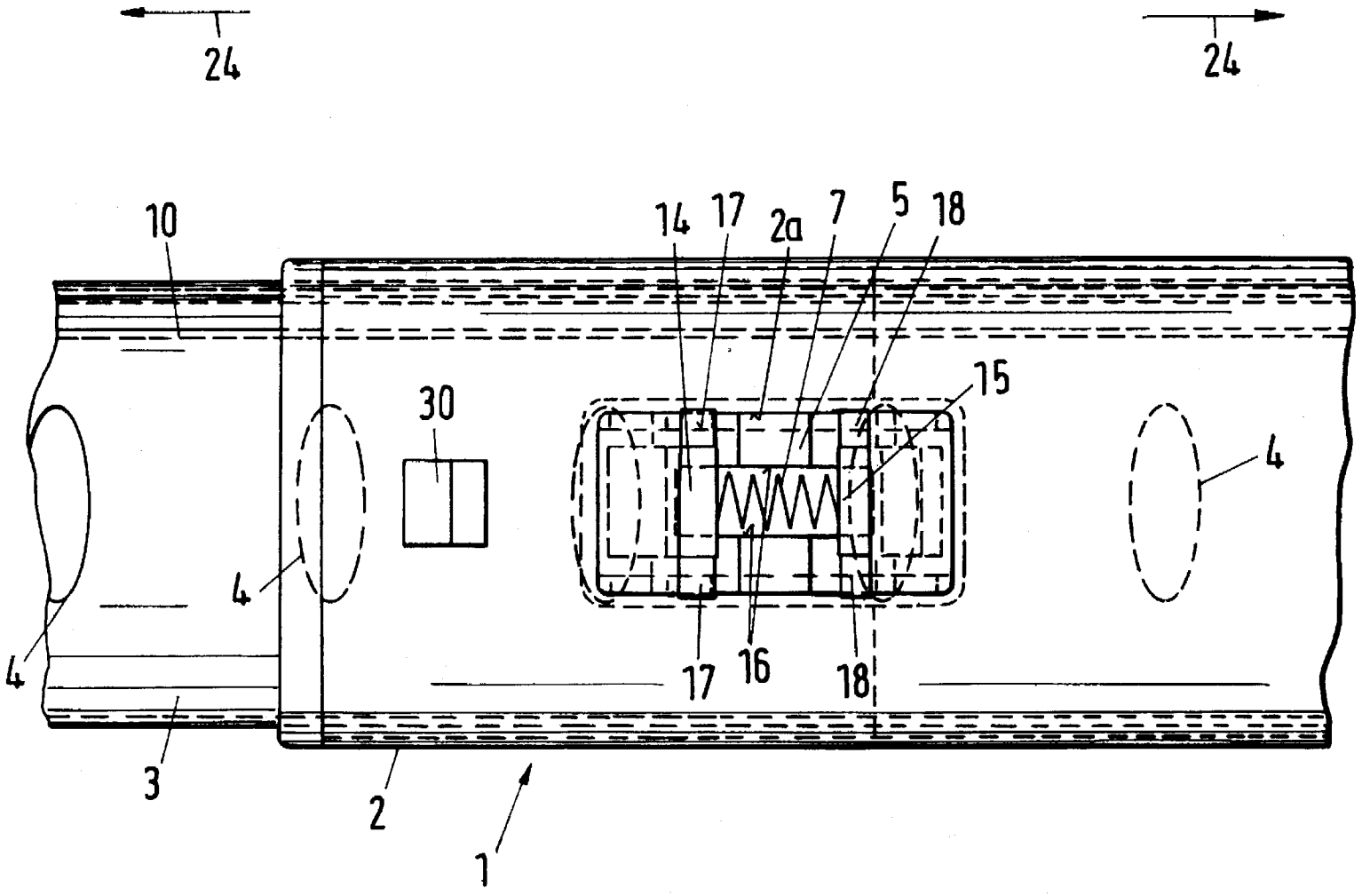
FIG. 7 is a plan view of FIG. 4 with the removed slider, of the inventive vacuum cleaner suction pipe.

FIG. 7 shows a plan view of FIG. 4. As can be seen from this figure, the both ends 14*a* and 15*a* of the clamping bodies 14, 15 are located under the action of the strongly compressed blocking spring 7 in a lifted position, so that the arresting depressions 4 in the inner pipe 3 which are located underneath are displaceable relative to the outer pipe 2. During the above-described unlocking of the clamping body 14 by the slider 6, the end 15*b* with its projections 18 of the other clamping body 15 is provided with a not shown free running in the slider. Therefore without hindrance it can slide by the relative displacement of the outer pipe 2 to the inner pipe 3, on the outer surface 4*a* of the arresting depression 4.

In the above-described pulling-out position of the pipes 2, 3 in direction of the arrow 24, the displacement of the slider 6 is performed in the pulling direction 6*a*, for example, by a thumb of the operator hand.

Figure 5:
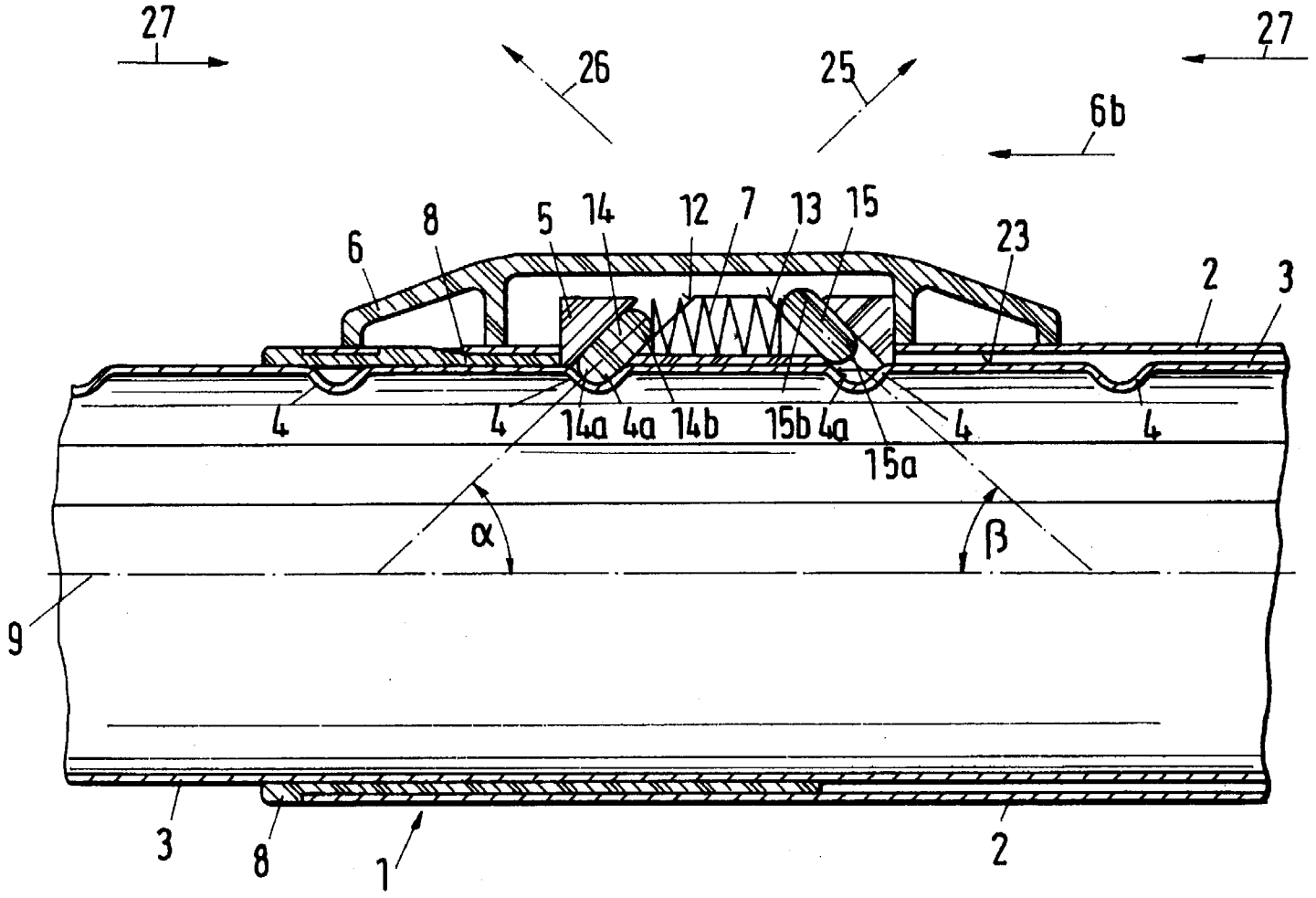
FIG. 5 is a view corresponding to the view of FIG. 1 for displacing the inner pipe and the outer pipe in one another, wherein the slider is displaced in the direction of the arrow 6*b* to the left and thereby the right blocking clamping body is lifted on the outer peripheral line of the inner pipe.

If to the contrary the inner pipe 3 is inserted in the outer pipe 2 in accordance with the arrow 27, then the slider 6 in accordance with FIG. 5 is displaced in direction of the arrow 6*b* until it engages with its rear projection, the projection 18 at the end 15*b* of the right clamping body 15. Thereby the clamping body 15 is displaced on its inclined sliding plane 13 in direction of the arrow 26 so far until it sits with its other end 15*a* on the outer peripheral line 23 of the inner pipe 3. Also, this movement of the clamping body 15 is performed opposite to the action of the blocking spring 7. When now the inner pipe 3 is displaced in the outer pipe 2 in direction of the arrow 27, the clamping body 14 is pressed in direction of the arrow 25 by the rising surface 4*a* of its arresting depression 4, until its lower end 14*a* is also set on the outer peripheral line 23 of the inner pipe 3. This position is shown in FIG. 6.

Figure 6:
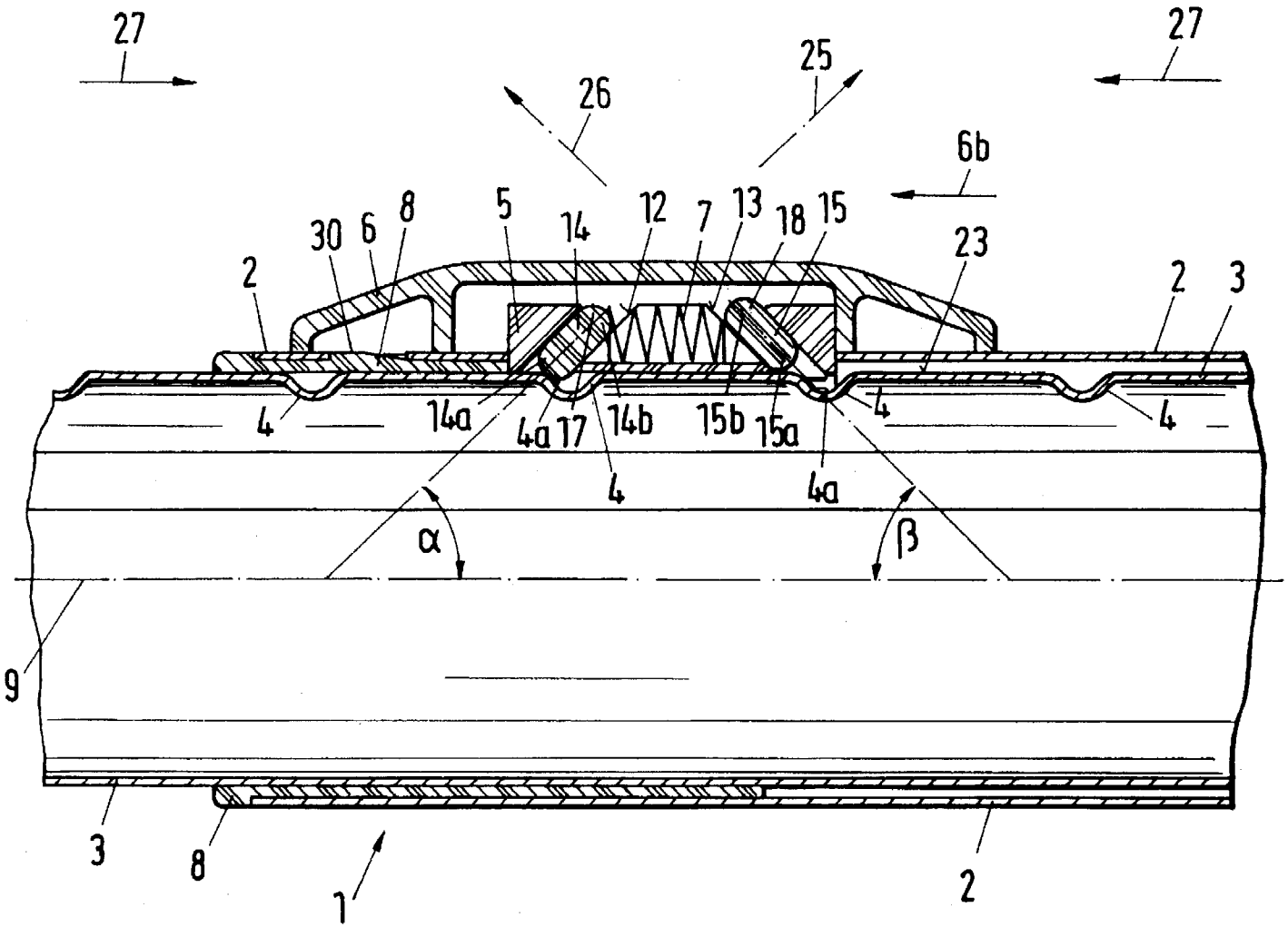
FIG. 6 is a cross-sectional view corresponding to the view of FIG. 5, wherein by the insertion movement of the inner pipe and the outer pipe the left clamping body is also displaced on the outer peripheral line of the inner pipe.
Figure 8:
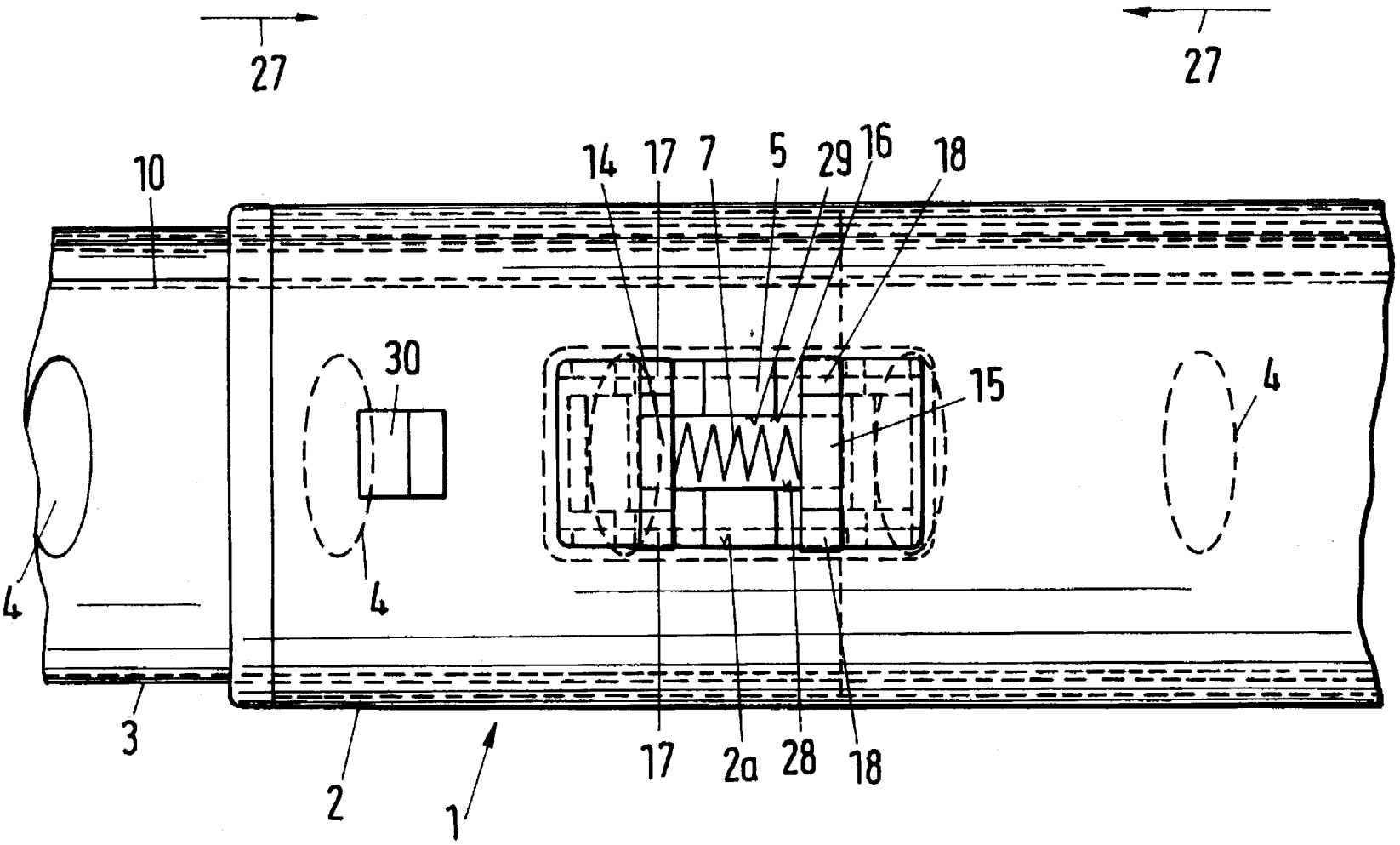
FIG. 8 is a plan view of FIG. 6 with the removed slider, of the inventive vacuum cleaner suction pipe.

The plan view of FIG. 6 is shown in FIG. 8. It can be seen from this Figure that the blocking spring 7 is compressed relative to its position of FIG. 1, but insignificantly since the displacement path of both clamping bodies 14, 15 is short. As a result, also the force to be applied by the operator to the slider is low. Furthermore, the actuation of the slider 6 is performed in ergonomically favorable manner, for example by the thumb of the operator's hand in the insertion direction of the arrow 27. As a result, for the operation of the blocking spring 7 only a low spring hardness is sufficient, and the spring can be formed relatively soft. Its only function is, in contrast to the prior art, to displace both clamping bodies 14, 15 in an arresting depression 4, so that there lower ends 14*a*, 15*a* fill the arresting depression 4. The blocking action itself in form of the inventive automatic clamping action of the clamping bodies 14, 15 is performed under the action of a clamping affect due to a relative displacement of the outer pipe 2 to the inner pipe 3 or visa versa.

When for example without actuation of the slider 6 in accordance with FIGS. 1, 3 and 4 the outer pipe 2 and the inner pipe 3 are pulled from one another in direction of the arrow 24, then by the friction forces which are applied to the clamping body 14 through the outer pipe 2 and with which the guiding body 5 located in the recess 2*a* on the one hand and the surface 4*a* of the arresting depressing 4 of the inner pipe 3 on the other hand, a clamping force is applied to the clamping body 14, urging to pull it opposite to the direction of the arrow 25 between the pipes 2, 3. Since thereby the clamping forces progressively increase, therefore in the case of impact-like pull loading in direction of the arrow 24, an undesired relative displacement of the outer pipe 2 to the inner pipe 3 is impossible. The hardness and the pretensioning of the blocking spring 7 have no impact on the self-locking clamping action.

When to the contrary, an impact-like pressure loading is applied to the inner pipe 3 and the outer pipe 2 in direction of the arrow 27 in FIGS. 1, 5 and 6, the right clamping body 15 is clamped in self-locking manner by frictional forces applied through the outer by the guiding body 5 of the one hand and the fictional forces from the outer surface 4*a* of the arresting depression 4 of the inner pipe 3 on the other hand. Therefore it is pulled into deeper position of an imaginary gap between the outer pipe 2 and the inner pipe 3. In this case, the other clamping body 14 takes part in this clamping action. Also, the blocking spring 7 does not have the smallest influence on the self-locking clamping action. The corresponding blocking positions are therefore liftable only when the corresponding blocking clamping body 14 or 15 engaged at its projections 17 and 18 is engaged by the slider 6 and displaced in the corresponding displacement direction in accordance with the arrow's 25 and 26 and along the corresponding inclined sliding planes 12, 13 and lifted from the arresting depression.

Figure 9:
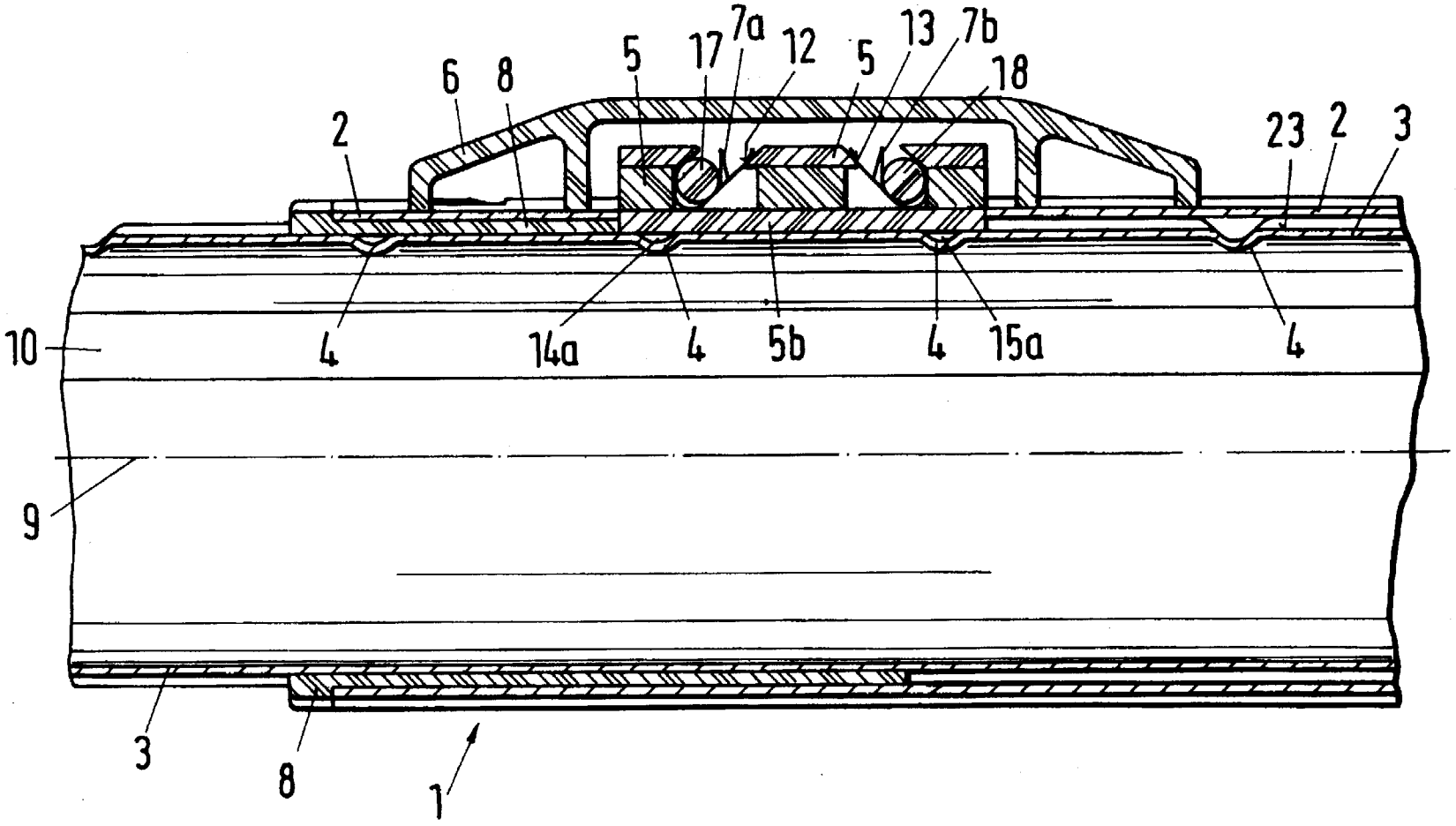
FIG. 9 is a view showing a cross-section taken along the line IX—IX in FIG. 2.

FIG. 9 shows a section taken along the line IX—IX in FIG. 2. The circularly formed projections 17, 18 formed as a turning axle in the cross-section at the upper ends 14*b*, 15*b* of the clamping body 14, 15 are clearly shown in this drawing. Also, it can be seen that the inclined planes 12, 13 are interrupted in their central region for forming the recess 16 for insertion of the blocking spring 7, and the blocking spring 7 is partially engaged by side walls 28, 29 as shown in FIG. 8. Also, the longitudinal sides 5*b* of the guiding body 5 can be seen in this drawings.

It will be understood that each of the elements described above, or two or more together, may also find a useful application in other types of constructions differing from the types described above.

While the invention has been illustrated and described as embodied in telescopable vacuum cleaner suction pipe, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A telescopable vacuum cleaner suction pipe, comprising an outer pipe and an inner pipe with arresting depressions; an arresting element coupled with said outer pipe and engaging in said arresting depressions; a manually actuatable slider unblocking said arresting element; a pressure-loaded blocking spring which when said slider is not actuated holds said arresting element in a locking position and when the slider is actuated said arresting element is movable against said blocking spring to unlocking position for a relative displacement of said inner pipe and said outer pipe, said arresting element being formed as two clamping bodies engaging in separate of said arresting depressions and inclined at acute angles relative to a longitudinal axis of said outer pipe; a guiding body form-lockingly received in said outer pipe and having inclined sliding planes on which said clamping bodies are displaced, one of said clamping bodies which blocks a relative movement of said inner pipe and said outer pipe being displaceable for releasing its blocking position via said slider from said arresting depression along said inclined sliding plane.

2. A telescopable vacuum cleaner suction pipe as defined in claim 1, wherein said outer pipe has a recess in which said guiding body is formed-lockingly engaged.

3. A telescopable vacuum cleaner suction pipe as defined in claim 2, wherein said guiding body has longitudinal sides provided with arresting grooves, said recess of said outer pipe having longitudinal edges which form-lockingly engage in said arresting grooves of said longitudinal sides of said blocking body, said guiding body having smaller sides which completely abut against associated small edges of said recess of said outer pipe.

4. A telescopable vacuum cleaner suction pipe as defined in claim 2, wherein said guiding body has longitudinal sides provided with arresting grooves, said recess of said outer pipe having longitudinal edges which form-lockingly engage in said arresting grooves of said longitudinal sides of said blocking body, said guiding body having smaller sides which partially abut against associated small edges of said recess of said outer pipe.

5. A telescopable vacuum cleaner suction pipe as defined in claim 2, wherein said guiding body has sides which face edges of said recess of said outer pipe and is provided at said sides with rear projections for arresting with said outer pipe when said guiding body is inserted in said recess of said outer pipe.

6. A telescopable vacuum cleaner suction pipe as defined in claim 5, wherein said rear projections extend completely over said sides of said guiding body.

7. A telescopable vacuum cleaner suction pipe as defined in claim 5, wherein said rear projections extend partially over said sides of said guiding body.

8. A telescopable vacuum cleaner suction pipe as defined in claim 5, wherein said rear projections provide for a form-locking arresting of said guiding body in said recess of said outer pipe.

9. A telescopable vacuum cleaner suction pipe as defined in claim 5, wherein said rear projections for a force-transmitting arresting of said guiding body in said recess of said outer pipe.

10. A telescopable vacuum cleaner suction pipe as defined in claim 5, wherein said rear projections for a form-locking and force-transmitting arresting of said guiding body in said recess of said outer pipe.

11. A telescopable vacuum cleaner suction pipe as defined in claim 5, wherein said guiding body has a part which engages in said recess of said outer pipe, said part having a concave abutment surface at said inner pipe and a small distance which is substantially equal to a difference between an inner radius of said outer pipe and an outer radius of said inner pipe with a small play of a sliding fit.

12. A telescopable vacuum cleaner suction pipe as defined in claim 1, wherein said clamping bodies are formed so that each of said clamping bodies during relative pressure or pull application of said outer pipe relative to said inner pipe and vice versa is pullable as a wedge in a progressively increasing clamping position which is independent from a pressure action of said blocking spring.

13. A telescopable vacuum cleaner suction pipe as defined in claim 1, wherein said clamping bodies are formed so that for releasing the blocking position of said outer pipe with said inner piper one of said clamping bodies which is blocking is liftable via said slider from said arresting depression along said inclined sliding plane against the force of said blocking spring on an outer peripheral line of said inner pipe, while during a following relative movement of said outer pipe relative to said inner pipe the other of said clamping bodies is displaceable over a raising surface of said arresting depression also against the force of said blocking spring on an outer peripheral line of said inner pipe.

14. A telescopable vacuum cleaner suction pipe as defined in claim 1, wherein said clamping bodies are formed as plates.

15. A telescopable vacuum cleaner suction pipe as defined in claim 1, wherein said clamping bodies are formed as wedges.

16. A telescopable vacuum cleaner suction pipe as defined in claim 1, wherein each of said clamping bodies at its end facing said arresting depression has a cross-sectional shape which is flat, rounded at one end and is trapezoidal.

17. A telescopable vacuum cleaner suction pipe as defined in claim 1, wherein each of said clamping bodies at its end facing said arresting depression has a cross-sectional shape which is flat, rounded at one end and is web-shaped.

18. A telescopable vacuum cleaner suction pipe as defined in claim 1, wherein said slider has rear projections, each of said clamping bodies at its end facing away from said arresting depression being provided with lateral projections which together with said rear projections of said slider form a form-locking sliding coupling.

19. A telescopable vacuum cleaner suction pipe as defined in claim 18, wherein during a coupling engagement of said projections of one of said clamping bodies which is lifted from its clamping position with said slider, said projections of the other of said clamping body are provided with a free running in said slider in a displacing direction of said one clamping body.

20. A telescopable vacuum cleaner suction pipe as defined in claim 1, wherein said inclined planes of said guiding body are provided with a recess for insertion of said blocking spring acting simultaneously on said clamping bodies.

21. A telescopable vacuum cleaner suction pipe as defined in claim 1, wherein said sliding planes of said guiding body are inclined relative to said longitudinal axis of said outer pipe by an identical angle.

22. A telescopable vacuum cleaner suction pipe as defined in claim 1, wherein each of said sliding planes of said guiding body are inclined relative to said longitudinal axis of said outer pipe by an angle of substantially 45°.

23. A telescopable vacuum cleaner suction pipe as defined in claim 1, wherein said pressure-loaded blocking spring is formed as a cylindrical helical spring.

24. A telescopable vacuum cleaner suction pipe as defined in claim 1, wherein said pressure loaded blocking spring is formed as a flat-shaped spring.

25. A telescopable vacuum cleaner suction pipe as defined in claim 1, wherein said pressure loaded blocking spring is formed as a double-sided bevel spring.

26. A telescope vacuum cleaner suction pipe as defined in claim 1, wherein said blocking spring is formed as an entropie-elastic rubber spring.

27. A telescopable vacuum cleaner suction pipe as defined in claim 1, wherein said slider overlaps said recess of said outer pipe from all sides and is formed so that after insertion of said guiding body in said recess of said outer pipe and also after insertion of said clamping bodies and said blocking spring in said recess of said outer pipe, said slider is arranged so that it is connected with and also relatively displaceable to said guiding body.

28. A telescopable vacuum cleaner suction pipe as defined in claim 27, wherein said slider is form-lockingly connected with said guiding body.

29. A telescopable vacuum cleaner suction pipe as defined in claim 27, wherein said slider is force-transmittingly connected with said body.

30. A telescopable vacuum cleaner suction pipe as defined in claim 27, wherein said slider is form-lockingly and force-transmittingly connected with said guiding body.

31. A telescopable vacuum cleaner suction pipe as defined in claim 27, wherein said slider is clipped on said guiding body.

32. A telescopable vacuum cleaner suction pipe as defined in claim 27; and further comprising a guiding screw which connects said slider with said guiding body.

33. A telescopable vacuum cleaner suction pipe as defined in claim 27; and further comprising a pin which connects said slider with said guiding body.

34. A telescopable vacuum cleaner suction pipe as defined in claim 1, wherein said clamping bodies, said guiding body and said slider are composed of a synthetic plastic material, said blocking spring being composed of spring steel.

35. A telescopable vacuum cleaner suction pipe as defined in claim 1, wherein said clamping bodies, said guiding body, and said slider are composed of a synthetic plastic material, said blocking spring being formed as a rubber spring composed of an entropi-elastic material.

36. A telescopable vacuum cleaner suction pipe as defined in claim 1; and further comprising means for non rotatable connection of said inner pipe with said outer pipe and including an axial groove provided in said inner pipe and extending parallel to its longitudinal axis, a synthetic plastic circular cylinder inserted between said outer pipe and said inner pipe and non-rotatably coupled with said outer pipe by an arresting cam, and an arresting strip provided on said cylinder and engaging in said axial groove.

* * * * *